United States Patent [19]

Terada et al.

[11] Patent Number: 4,930,323

[45] Date of Patent: Jun. 5, 1990

[54] DOUBLE LOCKABLE SLIDERS

[75] Inventors: Yasuharu Terada, Uozu; Yoshiyuki Horita, Toyama; Susumu Ishii, Kurobe, all of Japan

[73] Assignee: Yoshida Kogyo K. K., Tokyo, Japan

[21] Appl. No.: 434,429

[22] Filed: Nov. 13, 1989

[30] Foreign Application Priority Data

Nov. 25, 1988 [JP] Japan ..... 63-153343[U]

[51] Int. Cl.[5] ..... E05B 67/38

[52] U.S. Cl. ..... 70/68

[58] Field of Search ..... 70/68, 64, 67; 24/386–387, 418, 425–426

[56] References Cited

U.S. PATENT DOCUMENTS

| | | | |
|---|---|---|---|
| 4,350,375 | 9/1982 | Bako | 70/68 |
| 4,578,966 | 4/1986 | Kasai | 70/68 |
| 4,691,540 | 9/1987 | Morase | 70/68 |
| 4,756,173 | 7/1988 | Yang | 70/68 |

FOREIGN PATENT DOCUMENTS

| | | | |
|---|---|---|---|
| 211708 | 5/1980 | Fed. Rep. of Germany | 70/68 |
| 62-35815 | 9/1987 | Japan . | |
| 62-182360 | 11/1987 | Japan . | |
| 63-110211 | 7/1988 | Japan . | |

*Primary Examiner*—Robert L. Wolfe

*Attorney, Agent, or Firm*—Hill, Van Santen, Steadman & Simpson

[57] ABSTRACT

Double lockable sliders comprise a pair of first and second sliders reciprocatively mounted on the slide fastener and disposed reversely to each other. When the second pull tab is turned flat against the first pull tab, the engaging projection provided at the distal end and on one surface of the second pull tab comes into the recess formed in one surface of the first pull tab, and the prong provided at one end of the latch member resiliently comes into locking engagement with the indentation formed in one side of the engaging projection. The double lockable sliders further include cam means for imparting to the engaging projection upward motion when the latch member is pulled away from the second slider longitudinally of the slide fastener.

8 Claims, 5 Drawing Sheets

DOUBLE LOCKABLE SLIDERS

BACKGROUND OF THE INVENTION

1. Field of the invention:

The present invention relates to a pair of interlockable sliders for slide fasteners which sliders are mounted reversely on a common slide fastener in such a manner to reciprocate independently of each other for opening and closing the slide fastener and which sliders can be locked together against movement away from each other in their fully closed position on the slide fastener (hereinafter referred to as "double lockable sliders" for brevity). Such double lockable sliders find application on travelling bags, carrying cases and like articles.

2. Description of the Prior Art:

There have been heretofore proposed such double lockable sliders, typical examples of which are disclosed in Japanese Patent Publication No. 62-35815, and Japanese Laid-open Utility Model Publications Nos. 62-182360 and 63-110211. The double lockable sliders disclosed in each of these publications comprise a pair of sliders mounted reversely on a common slide fastener and having the respective pull tabs pivotally attached thereto, the pull tab of either one of the sliders having a locking mechanism. The pull tab of said one slider is turned flat against the other pull tab of the other slider overlying the slider body of said other slider, and then locked to said other pull tab by means of the locking mechanism.

These conventional double interlockable sliders are advantageous, indeed, in being very easy to lock. Nevertheless, there still remain various drawbacks. In order to open the slide fastener from its locked disposition, the user must unlock the locking mechanism of said one slider first, then turn the pull tab of said one slider backward, and thereafter, reciprocate the slider along the slide fastener. It is, therefore, very difficult if not impossible to manipulate the slider for opening the slide fastener through one action by his one hand.

Furthermore, since the pull tab of said one slider is turned flat against the combined thicknesses of the pull tab and the underlying slider body of the other slider, the interlocked double sliders as a whole exhibit bulky and unsightly appearance.

Still furthermore, the pull tabs of double lockable sliders are unstable in postures in locked disposition.

Yet furthermore, the sliders in locked disposition, would be very liable to be separated from each other between the front ends of their respective slider bodies, under severe stresses tending to separate the locked sliders apart, so that the slide fastener is apt to open accidentally.

SUMMARY OF THE INVENTION

With the foregoing drawbacks in view, it is an object of the present invention to provide double lockable sliders for slide fasteners which are very easy to lock together.

It is another object of the present invention to provide double lockable sliders for slide fasteners wherein unlocking operation of the sliders to open the slide fastener can be effected simply through one action by only one hand.

It is still another object of the present invention to provide double lockable sliders for slide fasteners which exhibit thin and attractive appearances in locked disposition.

It is yet another object of the invention to provide double lockable sliders for slide fasteners wherein the pull tabs of the double lockable sliders are held stable in postures in locked disposition.

It is still another object of the present invention to provide double lockable sliders for slide fasteners which can keep their respective confronting front ends substantially contacted with each other in locked disposition, even under severe stresses tending to separate the slider bodies apart.

According to the present invention, there is provided double lockable sliders for slide fasteners comprising a pair of first and second sliders reciprocatively mounted on the slide fastener and disposed reversely to each other, each of said sliders including a slider body having an attachment lug on its upper surface and a pull tab adapted for manipulating the slider, the pull tab including a proximal portion having a pivotal portion connected with the attachment lug for both pivotal movement thereon and reciprocative movement therealong and a pull tab body extending integrally from the proximal portion, the first pull tab of a first slider further including a recess formed in one surface of the pull tab body close to proximal portion, a box-like portion having therein a chamber communicating with the recess, and a latch member having a prong at its one end, housed within the chamber for being reciprocatively movable longitudinally of the pull tab and normally urged so as to bring the prong into the recess; the second pull tab of a second slider further having at the distal end and on one surface thereof an engaging projection which, in turn, has an indentation in its side close the distal end of the second pull tab; when the first pull tab is turned flat against the first slider body and then the second pull tab is turned flat against the first pull tab, the engaging projection of the second pull tab coming into the recess of the first pull tab and the prong of the latch member resiliently coming into locking engagement with the indentation of the engaging projection; the double lockable sliders further including cam means for imparting to the engaging projection upward motion when the latch member is pulled away from the second slider longitudinally of the slide fastener.

The above and other objects, features and advantages of the present invention will become apparent to those skilled in the art from the following detailed description made with reference to the accompanying drawings in which preferred embodiments incorporating the principles of the present invention are shown by way of example only.

DETAILED DESCRIPTION

FIGS. 1 through 7, inclusive, show one preferred embodiment of the present invention. As better shown in FIGS. 6 and 7, a pair of first and second sliders 3, 4 are mounted on a common slide fastener 1 and disposed reversely to each other, with their respective front ends 6, 7 facing each other. The sliders 3, 4 are reciprocatively movable independantly of each other on and along the slide fastener 1 to open and close the slide fastener 1.

Figure 1:
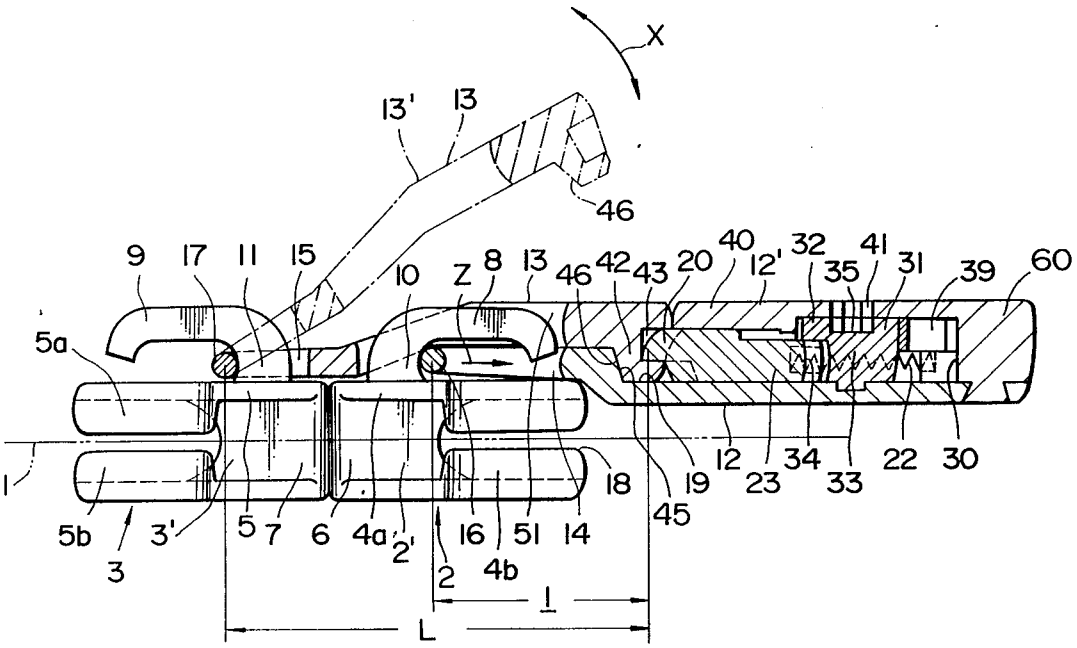
FIG. 1 is an enlarged side view, partly in cross-section, of double lockable sliders according to the present invention, showing them in provisionally locked disposition.
Figure 2:
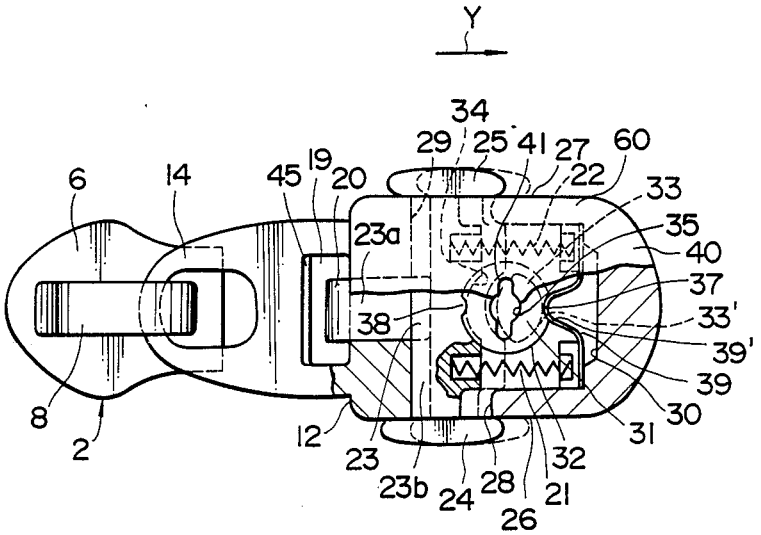
FIG. 2 is an enlarged plan view, partly in cross-section, of one or a first slider of the double lockable sliders of FIG. 1.
Figure 3:
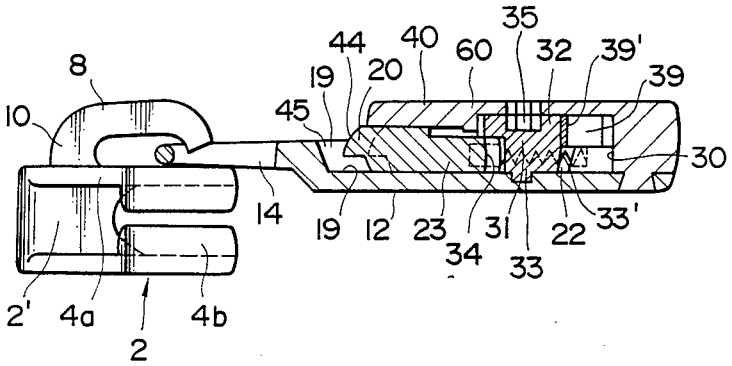
FIG. 3 is an enlarged side view, partly in cross-seciton, of the slider of FIG. 2.
Figure 5:
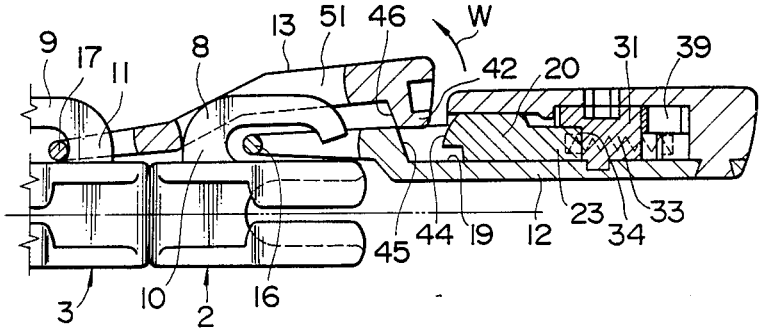
FIG. 5 is a view similar to FIG. 4, but showing the double lockable sliders in unlocked disposition.
Figure 6:
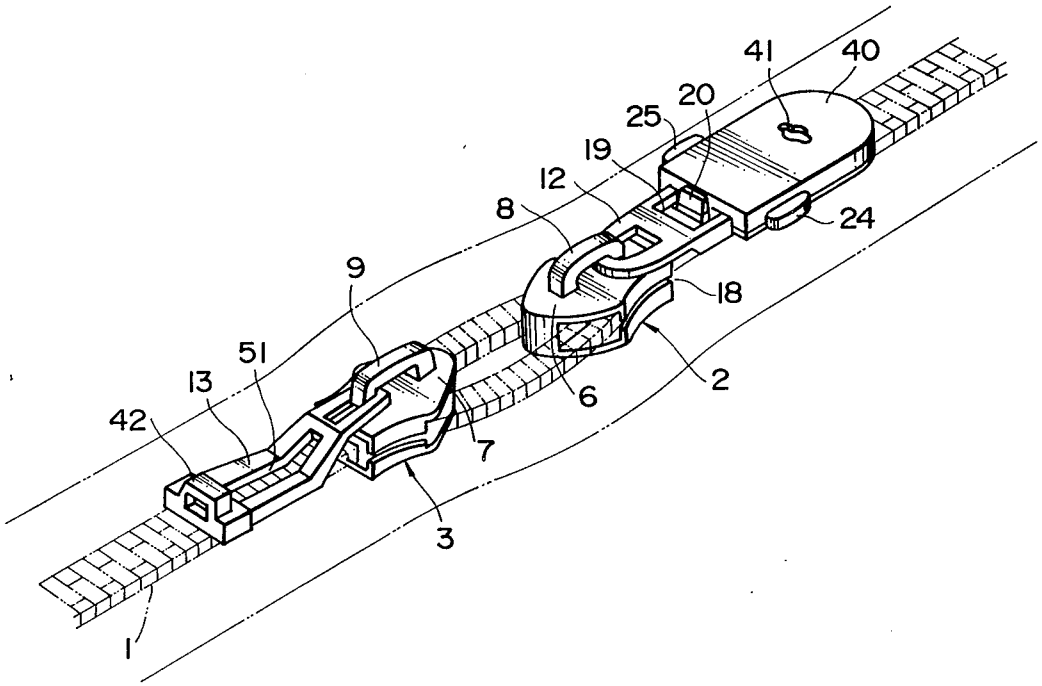
FIG. 6 is a fragmentary perspective view of a slide fastener on which the double lockable sliders according to the present invention are mounted, standing in unlocked disposition.

As shown in FIGS. 1 and 5, each of the sliders 2, 3 broadly comprises a slider body 2', 3' and a pull tab 12, 13 pivotally mounted on the slider body 2', 3' for manipulation of the sliders 2, 3. The slider bodies 2', 3' of the double lockable sliders 2, 3 are identical in construction with each other and may be of commonplace construction which is already well-known in the art. Each of the slider bodies 2', 3' comprises a pair upper and lower wings 4*a*, 5*a*; 4*b*, 5*b* joined at its front end 6, 7 with each other. A U-shaped attachment lug 8, 9 is mounted at its proximal end 10, 11 at the front end 6, 7 of and on the upper surface of the upper wing 4*a*, 5*a* and extends rearwardly longitudinally of the slider body 2', 3' to thus define an elongated space with the the upper surface of the upper wing 4*b*, 5*b*. Each of the pull tabs 12, 13 broadly comprises a proximal portion 14, 15 having a pivotal portion 16, 17 pivotally connected with the attachment lug 8, 9 and a pull tab body 12', 13' extending integrally therefrom. In addition to being pivotally movable to the attachment lug 8, 9 as indicated by double-headed arrow X in FIG. 1, the pull tabs 12, 13 are reciprocatively movable within the elongated space along the attachment lug 8, 9. As better shown in FIG. 3, the pull tab body 12' of the first pull tab 12 is thicker than the proximal portion 14 in such a manner to have additional thicknesses on both sides of the plane of the proximal portion 14. The pull tab body 12' includes a recess 19 disposed close to the proximal portion 14, a box-like portion 60 disposed contiguous to the recess 19, and a cover plate 40 attached to the upper side of the box-like portion 60. The box-like portion 60 has therein a chamber 30 which is open upwardly and communicates with the recess 19. As shown in FIG. 2, the box-like portion 60 also has in its opposed sides a pair of slots 28, 29 which are also communicated with by the chamber 30. A T-shaped latch member 23 is disposed within the chamber 30 on its side close to the recess 19 or the left side (as viewd in FIG. 2) for movement longitudinally of the pull tab 12. The T-shaped latch member 23 comprises a stem portion 23*a* and a crossbar 23*b* extending normally and in both directions from the top end thereof. The stem portion 23*a* extends longitudinally of the pull tab 12 toward the recess 19 and terminates in a locking prong 20. The crossbar 23*b* has the opposed ends pass through the respective slots 28, 29 and is provided at the opposed ends with the respective knobs 24, 25 for facilitating the manipulation of the latch member 23. A pair of compression springs 21, 22 each act between the crossbar 25 and that inner wall of the chamber 30 which is remote from the recess 19 and jointly function to normally urge the T-shaped latch member 23 so as to cause its prong 20 protrude into the recess 20. Gripping the knobs 24, 25 and pulling them in the direction indicated by an arrow Y against the bias of the compression springs 21, 22 causes the prong 20 retract from the recess 19, as seen in FIG. 3. The crossbar 23*b* is formed in the side opposite to the stem portion 23*a* with an concave abutting surface 34 for abutting engagement with a rotary body 31 to effect full locking of the double lockable sliders 2, 3, as described closely hereinbelow.

Figure 4:
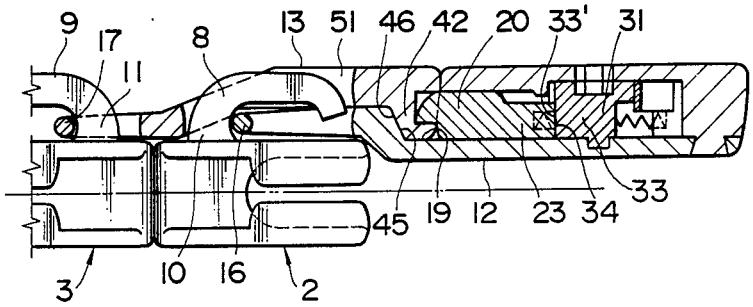
FIG. 4 is an enlarged side view, partly in cross-section and partly omitted, of the double lockable sliders of FIG. 1 but showing them in fully locked disposition.
Figure 7:
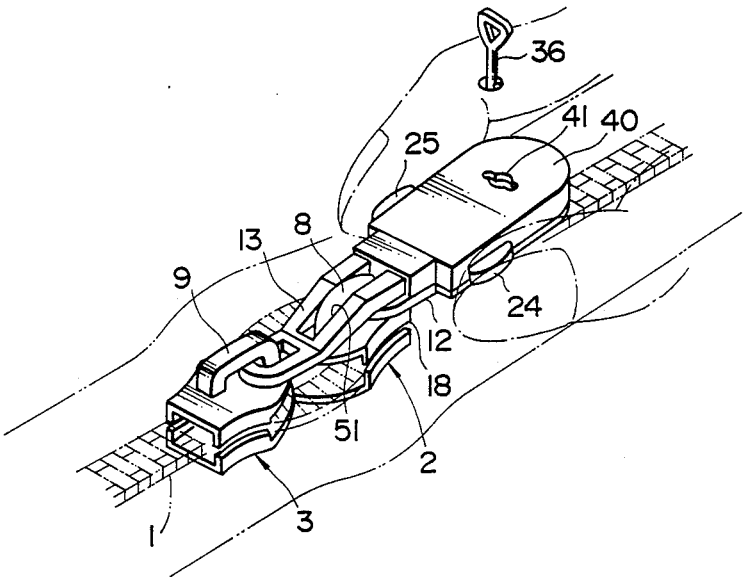
FIG. 7 is a view similar to FIG. 6 but showing the double lockable sliders in locked disposition.

Within the chamber 30 and on that side of the latch member 23 which is remote from the recess 19 a rotary body 31 is rotatably mounted. The rotary body 31 comprises an upper circular disk 32 and a lower ellipsoidal body 33 extending integrally downwardly therefrom and positioned in confronting relation to the abutting surface 34 of the T-shaped latch member 23. The lower ellipsoidal body 33 is disposed eccentrically to the upper circular disk 32, thus providing a convex stopper surface 33' closely to and along the periphery of the upper circular disk 32. The rotary body 31 is rotatable between the first position in which the convex stopper surface 33' comes out of stopping engagement with the concave abutting surface 34 of the latch member 23, as shown in FIGS. 1 through 3, and the second position in which the convex stop surface 33' comes into stopping engagement with the concave abutting surface 34 of the latch member 23, as shown in FIG. 4. When the rotary body 31 is disposed in the first position, as shown in FIGS. 1 through 3; the convex stopper surface 33', as being out of stopping engagement with the concave abutting surface 34 of the latch member 23, allows the latch member 23 to move in the direction indicated by an arrow Y in FIG. 2; on the other hand, when the rotary disk is disposed in the second position, as shown in FIG. 4; then the convex stopper surface 33', as being in stopping engagement with the concave abutting surface 34 of the latch member 23, checks the movement of the latch member 23 in the direction of the arrow Y. The circular disk 32 is formed on its upper surface at its center with a key hole 35 for permitting the user to rotate the rotary body 31 by means of a separate key 36, as shown in FIG. 7, for selectively placing the rotary body 31 in the above-mentioned first and second positions.

The upper circular disk 33 is provided at its peripheral and diametrically opposite positions with a pair of notches 37, 38. A leaf spring 39 is disposed within the chamber 30 on that side of the rotary body 31 which is opposite to the latch member 23. The leaf spring 39 has its both ends connected to the inner wall of the chamber 30 and is bent arcuate at its middle to thus provide a protuberant retainer portion 39' projecting inwardly of the chamber 30. The leaf spring 39 has its protuberant retainer portion 39' normally urged into contact engagement with the periphery of the upper circular disk 33. The protuberant retainer 39' of the leaf spring 39 is engageable with the notches 37, 38 in order to retain the rotary body 31 selectively in the first position and the second position.

The cover plate 40 is attached to the upper side of the box-like portion 60 to cover the chamber 30. An outer key hole 41 is formed through the cover plate 40 and disposed in registry with the inner key hole 35 for insertion of the separate key 36 into the inner key hole 35 therethrough.

The second pull tab 13 has at the distal end and on one surface thereof an engaging projection 42. The engaging projection 42 is arranged such that, when the second pull tab 13 of the second slider 3 is turned flat against the first pull tab 12 already turned flat against the slider body 2' of the first slider 2, the engaging projection 42 comes into into fitting engagement with the recess 19 of the first pull tab 12. The engaging projection 42 has, in turn, has an indentation 43 in its side which is close to the distal end of the pull tab 13. As the engaging projection 42 is fitted into the recess 19, so the engaging projection 42 retracts the prong 20 from the recess 19 into the chamber 30 against the bias of the springs 21, 22 until the indentation 43 faces the prong 20, at which moment the prong 20 is restored into locking engagement with the indentation 43 under the bias of the springs 21, 22, so that the first and second sliders 2, 3 have been locked to each other. In order to facilitate the retraction of the prong 20 by the engaging projection 42, the prong 20 has at its tip a bevelled surface 44 as shown in FIGS. 3 and 5.

Since the pivotal portion 16 of the first pull tab 12 comes close to the proximal end 10 of the attachment lug 8 on the first slider 2, when the engaging projection 42 is locked by the prong 20 in the recess 20; there remains an ample space in which the pivotal portion 16 of the first slider 2 is movable along the attachment lug 8 in the direction indicated by an arrow Z in FIG. 1.

According to this embodiment, that edge 45 of the recess 19 which is close to the proximal portion 14 of the first pull tab 12 is bevelled and that side 44 of the projection 42 which is close to the proximal portion 15 of the second pull tab 13 is chamfered as well. The bevelled edge 45 of the recess 19 and the chamfered side 44 of the projection 42 jointly constitute cam means for imparting to the engaging projection 42 upward component of force or upward motion when the pull tab 12 is pulled in the direction indicated by an arrow Z in FIG. 1.

The second pull tab 13 has an aperture 51 formed in the pull tab body 13' for receiving the attachment lug 8 of the first slider 2 therein without interference when the second pull tab 13 is turned against the first pull tab 12. The pull tab body 12' of the first pull tab 12 is thicker than the proximal portion 14 in such a manner that the pull tab body 12' provide additional thickness on both upper and lower sides of the plane of the proximal portions 14. The thickness of the pull tab body 13' of the pull tab 13 is such that the upper surface of the pull tab body 13' is held in coplanar relation to the upper surface of the cover plate 40, when the second pull tab 13 is turned flat against the first pull tab 12. These features are combined to advantageously render the interlocked double lockable sliders as a whole less in thickness and more attractive in appearance.

Figure 8:
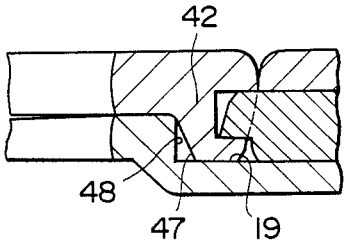
FIG. 8 is an enlarged cross-sectional view of part of the pull tabs of double lockable sliders according to another embodiment.
Figure 9:
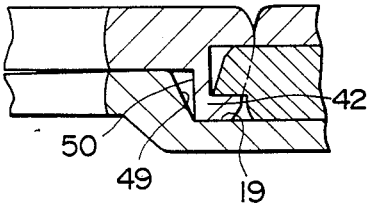
FIG. 9 is a view similar to FIG. 8 but showing still another embodiment.

Although, in the first embodiment, the cam means is jointly constituted by both the bevelled edge 45 of the recess 19 and the chamfered side 44 of the projection 42; as far as being able to impart to the engaging projection 42 upward component of force or upward motion, the cam means may be constituted by only a chamfered side 47 of the projection 42, in which event an edge 48 of the recess 19 stands normal to the general plate of the first pull tab 12, as shown in FIG. 8. Alternatively, the cam means may be constituted by only a bevelled edge 49 of the recess 19, in which event a chamfered side 50 of the projection 42 stands normal to the general plate of the second pull tab 13, as indicated in FIG. 9.

In locking operation, the pair of first and second sliders 2, 3 are first brought into abutting engagement with their respective front ends substantially contacted with each other to close the slide fastener 1. Then, the second pull tab 13 of the second slider 3 is turned flat against the already-flatly-laid first pull tab 12 with the engaging projection 42 fitted into the recess 19. As the engaging projection 42 is fitted into the recess 19, the engaging projection 42 retracts the prong 20 from the recess 19 through the camming action of the bevelled surface 44 against the bias of the springs 21, 22 until the indentation 43 comes to face the prong 20, at which moment the prong 20 comes into locking engagement with the indentation 43 under the bias of the springs 21, 22 in snapping action, so that the engaging projection 42 is locked by the prong 20 in the recess 19. Now, the first and second sliders 2, 3 have been locked together. It is to be noted that, in the locked disposition of the sliders 2, 3, the pivotal portions 14, 15 of the first and second pull tab 12, 13 come close to the respective proximal ends 10, 11 of the attachment lugs 10, 11 on the first and second sliders 2, 3, which advantageously prevents the sliders 2, 3 from getting separated between their confronting front ends 6, 7, even under severe stresses tending to separate the slider bodies 2', 3' apart. As seen in FIG. 1, the length 1 from the pivotal portion 17 to the recess 19 of the first pull tab 12 is by far less than the length L from the pivotal portion 17 to the engaging projection 42 of the second pull tab 13, which means that the turning radius by which the first-mentioned length 1 of second pull tab 13 turns is by far less than that by which the last-mentioned length L of the first pull tab 12. This advantageously helps to prevent the first and second pull tabs 2, 3 against accidental rotation on their respective pivotal portions 16, 17, thus maintaining the pull tabs 12, 13 in their stable postures.

So far, only provisional locking of the double lockable sliders 2, 3 has been accomplished as shown in FIGS. 1 and 3. For fully locking the sliders 2, 3, the separate key 36 is inserted through the outer key hole 41 into the inner key hole 35. Then, by means of the separate key 36, the rotary body 31 is rotated through the angle of 180 degrees from the first position indicated in FIGS. 1 and 3 into the second position indicated in FIG. 4, whereupon the convex stopper surface 33' of the lower ellipsoidal body 33 comes into stopping engagement with the concave abutting surface 34 of the latch member 23, thereby checking the movement of the latch member 23 in the direction of the arrow Y. Since the prong 20 will not retract out of the locking engagement with the indentation 43, the first and second sliders 2, 3 are fully locked to each other. In order to restore the thus-fully-locked sliders 2, 3 to the provisionally locked disposition, rotation of the rotary body 31 through further 180 degrees in either clockwise or anticlockwise direction is only a must.

For unlocking the first and second sliders 2, 3 from the provisionally locked disposition, knobs 24, 25 are gripped by fingers of a single hand and are pulled away from the second slider 3 so that the pivotal portion 16 of the first pull tab 12 of the first slider 2 is moved from the proximal end 10 of the attachment lug 8 toward the rear end 18 of the first slider 2. Continued pull of the knobs 24, 25 causes the latch member 23 retract, thereby bringing the prong 20 out of engagement with the indentation 43 of the engaging projection 42. As soon as the prong 20 comes out of engagement with the indentation 43 of the engaging projection 42, the bevelled edge 45 of the recess 19 and the chamfered side 44 of the projection 42 jointly functions as cam means to impart upward component of force or upward movement to the engaging projection 42, so that the second pull tab 13 comes snappingly out of engagement with the first pull tab 12. Further continued pull on the knobs 24, 25 with the single hand would cause the first slider 2 move apart from the second slider 3, thus opening the slide fastener 1. Thus, unlocking operation of the double lockable sliders 2, 3 to open the slide fastener 1 can be effected simply through one action by only one hand.

Obviously, various modifications and variations of the present invention are possible in the light of the above teaching. It is therefore to be understood that within the scope of the appended claims the invention may be practiced otherwise than as specifically described.

What is claimed is:

1. Double lockable sliders for slide fasteners comprising a pair of first and second sliders reciprocatively mounted on the slide fastener and disposed reversely to each other, each of said sliders including a slider body having an attachment lug on its upper surface and a pull tab adapted for manipulating the slider, the pull tab including a proximal portion having a pivotal portion connected with the attachment lug for both pivotal movement thereon and reciprocative movement therealong and a pull tab body extending integrally from the proximal portion, the first pull tab of a first slider further including a recess formed in one surface of the pull tab body close to proximal portion, a box-like portion having therein a chamber communicating with the recess, and a latch member having a prong at its one end, housed within the chamber for being reciprocatively movable longitudinally of the pull tab and normally urged so as to bring the prong into the recess; the second pull tab of a second slider further having at the distal end and on one surface thereof an engaging projection which, in turn, has an indentation in its side close the distal end of the second pull tab; when the first pull tab is turned flat against the first slider body and then the second pull tab is turned flat against the first pull tab, the engaging projection of the second pull tab coming into the recess of the first pull tab and the prong of the latch member resiliently coming into locking engagement with the indentation of the engaging projection; the double lockable sliders further including cam means for imparting to the engaging projection upward motion when the latch member is pulled away from the second slider longitudinally of the slide fastener.

2. Double lockable sliders for slide fasteners recited in claim 1, the cam means comprising that bevelled edge of the recess which is close to the proximal portion of the first pull tab.

3. Double lockable sliders for slide fasteners recited in claim 1, the cam means comprising that chamfered side of the projection which is close to the proximal portion of the second pull tab.

4. Double lockable sliders for slide fasteners recited in claim 1, the cam means comprising that bevelled edge of the recess which is close to the proximal portion of the first pull tab and that camfered side of the engaging projection which is close to the proximal portion of the second pull tab.

5. Double lockable sliders for slide fasteners recited in claim 1, the pivotal portions of the first and second pull tab coming close to the respective proximal ends of the attachment lugs of the first and second sliders, when the prong of the latch member resiliently comes into locking engagement with the indentation of the engaging projection.

6. Double lockable sliders for slide fasteners recited in claim 1, the latch member being formed at the other end with an abutting surface, the first pull tab further including a rotary body rotatably mounted within the chamber and on that side of the latch member which is remote from the recess, the rotary body comprising an upper circular disk and a lower stopper body extending integrally downwardly therefrom and positioned in confronting relation to the abutting surface of the latch member, the lower stopper body being disposed eccentrically to the upper circular disk, thus presenting a stopper surface closely to the periphery of the upper circular disk, the rotary body being rotatable between the first position in which the stopper surface comes out of stopping engagement with the abutting surface of the latch member and the second position in which the stopper surface comes into stopping engagement with the abutting surface of the latch member.

7. Double lockable sliders for slide fasteners recited in claim 5, a pair of notches being formed in its peripheral and diametrically opposite positions of the upper circular disk, the first pull tab further including a leaf spring provided within the chamber on that side of the rotary body which is opposite to the latch member, the leaf spring having its both ends connected to the inner wall of the chamber and being bent arcuate at its middle to thus provide a protuberant retainer portion, the leaf spring having its protuberant retainer portion normally urged into contact engagement with the periphery of the upper circular disk, so that the protuberant retainer of the leaf spring is engageable with the notches in order to retain the rotary body selectively in the first position and the second position.

8. Double lockable sliders for slide fasteners recited in claim 1, the second pull tab further having an aperture formed in the pull tab body for receiving the attachment lug of the first slider therein without interference when the second pull tab is turned flat against the first pull tab, the pull tab body of the first pull tab being thicker than the proximal portion in such a manner to provide additional thickness on both upper and lower sides of the plane of the proximal portions, the thickness of the pull tab body of the second pull tab being such that the upper surface of the pull tab body is held in coplanar relation to the upper surface of the pull tab body, when the second pull tab is turned flat against the first pull tab.

* * * * *